US008942380B2

(12) United States Patent
Stoll et al.

(10) Patent No.: US 8,942,380 B2
(45) Date of Patent: Jan. 27, 2015

(54) METHOD FOR GENERATING A DOWNWARD-COMPATIBLE SOUND FORMAT

(75) Inventors: Gerhard Stoll, Zolling (DE); Renate Stoll, legal representative, Zolling (DE); Melanie Stoll, legal representative, Zolling (DE); Christoph Stoll, legal representative, Zolling (DE); Jens Groh, Munich (DE); Martin Link, Gauting (DE); Jörg Deigmöller, Budenheim (DE); Bernfried Runow, Tuttlingen (DE); Martin Keil, Munich (DE)

(73) Assignee: Institut fur Rundfunktechnik GmbH, Munich (DE)

( * ) Notice: Subject to any disclaimer, the term of this patent is extended or adjusted under 35 U.S.C. 154(b) by 784 days.

(21) Appl. No.: 13/128,617

(22) PCT Filed: Nov. 7, 2009

(86) PCT No.: PCT/EP2009/007971

§ 371 (c)(1), (2), (4) Date: Jul. 14, 2011

(87) PCT Pub. No.: WO2010/054780

PCT Pub. Date: May 20, 2010

(65) Prior Publication Data

US 2012/0014526 A1 Jan. 19, 2012

(30) Foreign Application Priority Data

Nov. 11, 2008 (DE) ..... 10 2008 056 704

(51) Int. Cl.
*H04R 5/00* (2006.01)
*H04S 3/00* (2006.01)

(52) U.S. Cl.
CPC ..... *H04S 3/008* (2013.01)
USPC ..... 381/27

(58) Field of Classification Search
CPC ..... H04S 3/008; H04S 2400/03
USPC ..... 381/27
See application file for complete search history.

(56) References Cited

U.S. PATENT DOCUMENTS

2006/0178870 A1* 8/2006 Breebaart et al. ..... 704/205

OTHER PUBLICATIONS

David Griesinger, *Progress in 5-2-5 Matrix Systems*, Lexicon, XP002568517, Oct. 25, 2001, http://www.lexicon.com/logic7/whitepapers.asp.

Bernfried Runow et al., *Automatischer Stereo-Downmix von 5.1-Mehrkanalproduktionen*, XP002568518, Feb. 13, 2009, http://www.b-public.de/da/da_runow_downmix.pdf.

Bernfried Runow et al., *An Optimized Stereo-Downmix of a 5.1 Multichannel Audio Production*, Nov. 16, 2008, XP002568519, http://www.b-public.de/da/Dwonmix%20TMT-Manuskript-2008%20Runow.pdf.

English translation of International Preliminary Report on Patentability from PCT application No. PCT/EP2009/007971 dated May 17, 2011.

English translation of International Search Report from PCT application No. PCT/EP2009/007971 dated May 20, 2010.

* cited by examiner

*Primary Examiner* — Joseph Saunders, Jr.
(74) *Attorney, Agent, or Firm* — Workman Nydegger

(57) ABSTRACT

A method of generating an audio output signal according to a downward compatible sound format, the method including: generating a sum signal by combining a first input channel signal with a second input channel signal; and dynamically correcting the sum signal using samples of the first and second input channel signals from overlapping time windows.

25 Claims, 6 Drawing Sheets

METHOD FOR GENERATING A DOWNWARD-COMPATIBLE SOUND FORMAT

BACKGROUND OF THE INVENTION

The Relevant Technology

For regular broadcasting, internet, and the home area, besides two channel stereo and mono, the 5.1 sound format is also well established. Through the additional available sound formats there is an increased effort in audio production, in particular the effort of recording and mixing the respective sound formats. Also the compatibility to playback devices needs to be guaranteed, thus they need to be able to playback every sound format independent of the number of audio channels.

One possibility is the transmission of the sound format comprising the greatest number of audio channels and if necessary an automatic conversion of the signal by the receiver to a sound format with a smaller number of audio channels (automatic downmix).

It is also possible to generate the material in all formats during the audio production and broadcast those signals simultaneously (simulcast). In this case each sound format can be generated separately. However, this kind of mixing requires considerable production effort. In most cases this requires either additional manpower, a noticeable higher time effort or multiple sets of equipment (e.g. in the case of a live broadcast). Therefore the resulting volume of production is hardly acceptable. Alternatively—as in the approach described earlier—an automatic downmix can be done.

Such methods to automatically transform a sound format already exist, but further improvements are necessary in order to achieve a qualitatively satisfying result for a wide spectrum of basic raw material.

Automatic downmix methods can be categorised roughly into active and passive methods. Active methods adapt the automatic transformation depending on the basic raw material, where passive methods work independent of a signal. A known passive downmix method is the based on the broadcast reference ITU-R BS.775 and is illustrated in FIG. 1.

Based on a five channel sound format with the sound channels left channel (L)
right channel (R)
centre channel (C)
rear left channel (Ls)
rear right channel (Rs), the known downmix method is designed to lower the level of the centre channel (C), as well as the rear left channel (Ls) and the rear right channel (Rs) by −3 dB using a damping function 50, 60 or 70. The −3 dB lowered centre channel is distributed via the sum function 10 or 20 to the left channel and the right channel, while forming a first sum signal (output sum function 10) and a second sum signal (output sum function 20). The −3 dB lowered level of the rear and the rear right signal (Ls) and (Rs) are distributed via the sum function 30 and 40 to the first and second sum signal to form the left and right channel ($L_0$) and ($R_0$) of the desired two channel sound format.

For the active method the sum functions according to the block diagram of FIG. 1 are checked with respect to the properties of the summed audio signal and corrected, where needed in order to avoid unwanted sound results. Therefore a company called Coding Technology has suggested a downmix algorithm based on the ITU downmix according to FIG. 1. In the downmix algorithm, the energy content of all sum signals are analyzed in 28 frequency bands/partial bands and are compared with the energy content of the five channel audio format. In this way, increases and decreases of the energy content can be determined and compensated by correcting the amplitude in the affected partial bands. A change in the tone colour via the comb filter effect can be limited in this way. The correction only proceeds up to a meaningful level as the suffixing signal would cause an infinite correction factor. The downmix algorithm can cause shifts of the phantom sound source between the resulting left and right channels of the two channel sound format and in particular independent of the original position of the phantom sound source in the five channel source material.

In order to reduce such shifts of the phantom sound source, a company called Lexicon has suggested method Logic 7, where next to the downmix there is also the possibility of an upmix. The multi channel sound can be downmixed to a mono signal as well as to a stereo signal. Furthermore, it is possible, for example, to decode up to 8 channels out of a stereo downmix Therefore the fraction of a centre channel downmix is controlled via variable coefficients and the fraction of the rear right and rear left channels are adapted with further coefficients. For the left channel a fraction of 0.91 of the rear left channel is used with a fraction of −0.38 of the rear right channel. The mixing of the right channel proceeds accordingly. With this method the levels of both rear channels stay unchanged. Through a phase shift of 90° a later separation of both rear channels from the left and right channels are possible. But sound tone changes as of comb filter effects of the phase shift cannot be limited with the method Logic 7.

BRIEF DESCRIPTION OF THE DRAWINGS

Various embodiments of the present invention will now be discussed with reference to the appended drawings.

DETAILED DESCRIPTION OF THE PREFERRED EMBODIMENTS

The object of the invention is to largely compensate for the shift of the phantom sound source, the change in level difference between the coherent and incoherent signal parts as well as the sound tone changes.

The underlying idea of the invention is while forming the first (L') and second (R') sum signals, to dynamically correct each of the spectral values of overlapping time windows with (k) samples of the left channel (L) and right channel (R). Furthermore while forming the third and fourth sum signals, the spectral values of overlapping time windows with (k) samples of the first (L') and second (R') sum signals are each dynamically corrected.

Figure 2:
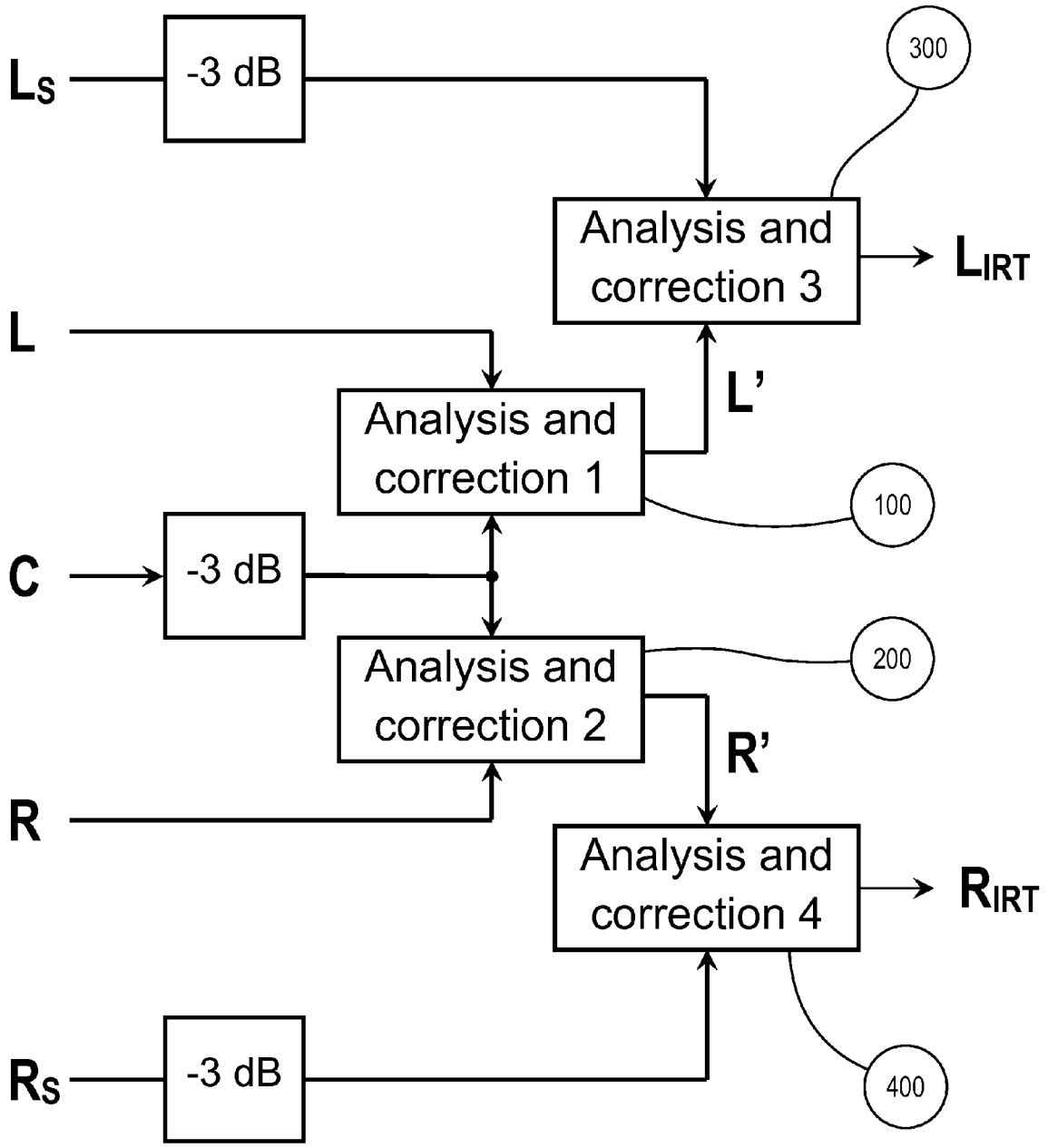
FIG. 2 is a general block diagram showing a method of generating a downward compatible sound format according to one embodiment of the present invention.

The invention is explained further while referring to the embodiment shown in FIGS. 2 to 6. It shows:

FIG. 2 is a general block diagram showing a method according to one embodiment of the invention; FIGS. 3 to 6 are flow charts for the analysis and correction blocks for the intended functions.

Figure 1:
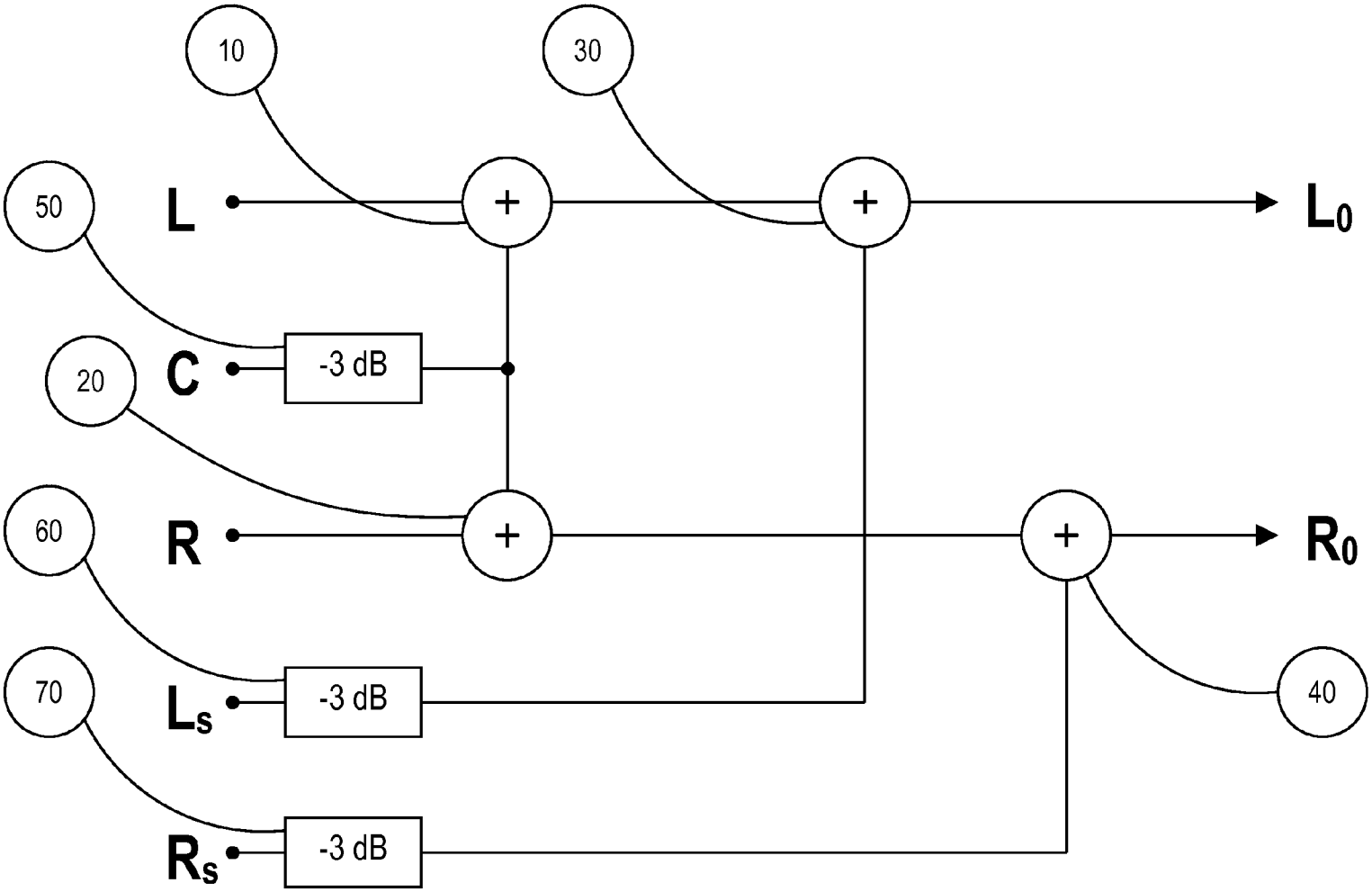
FIG. 1 illustrates a conventional downmix method.

The block diagram shown in FIG. 2 is similar to the block diagram in FIG. 1 but with a significant difference. For the sum functions 100 and 200 to form the first and second sum signals L' and R' as well as for the sum functions 300 and 400 to form the left and right signals $L_{lRT}$ and $R_{lRT}$ of the two channel sound format the sum functions are analysed and corrected (see Analysis and correction blocks 1-4) in addition to the summation. The lowering of the centre signal C as well as the rear right and rear left signals Ls and Rs is carried out in block diagram 2 in a similar manner to that discussed above regarding the block diagram of FIG. 1 (e.g. −3 dB via a damping function 50, 60 or 70). However, one could think of dampings other than −3 dB in particular depending on the genre or content of the five channel source signal.

The functional structures of the analysis in correction blocks 100, 200, 300 and 400 in FIG. 2 are shown respectively in FIGS. 3, 4, 5, and 6.

Figure 3:
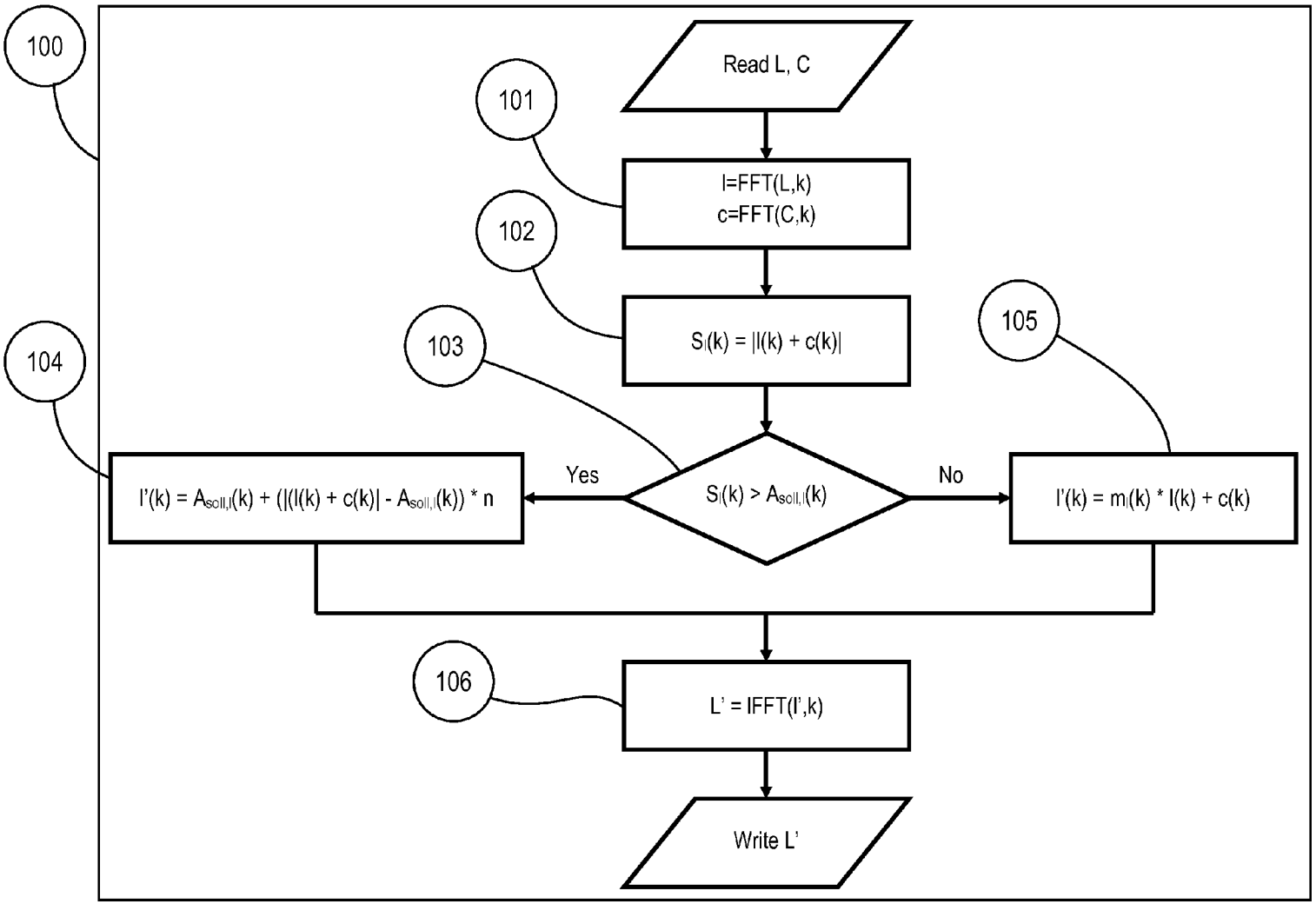
FIGS. 3-6 are block diagrams showing various embodiments of analysis and correction algorithms that can be used in the method illustrated in FIG. 2.

In FIG. 3, Analysis and Correction 1 (block 100) is designed to carry out a first transformation of the input left and centre signals L and C to spectral values, e.g. via FFTs, as shown in step 101. The formed spectral values 1(k), c(k) are added in the sum function shown in step 102. The absolute value $S_l(k)$ of the sum of the spectral values is assessed in step 103 according to if the absolute value $S_l(k)$ is greater than a desired value $A_{soll,l}(k)$. The desired value $A_{soll,l}(k)$ is determined according to the following:

$$A_{soll,l}(k)=\sqrt{|l(k)|^2+|c(k)|^2}$$

If the absolute value $S_l(k)$ is greater than $A_{soll,l}(k)$, then the value l'(k) of the left channel is determined according to step 104 as:

$$l'(k)=A_{soll,l}(k)+(|l(k)+c(k)|-A_{soll,l}(k))*n,$$

where n is a factor greater than 0.1 and less than 0.4.

If the absolute value $S_l(k)$ is not greater than the desired value $A_{soll,l}(k)$, then the spectral value l'(k) of the left channel is determined according to step 105, in which the spectral value l(k) is multiplied by a factor $m_l(k)$. The factor $m_l(k)$ is greater than 1 and is used to adapt the value similar to the aforementioned factor n. The product $m_l(k)*l(k)$ is added to the spectral value c(k) of the centre channel (i.e., $m_l(k)*l(k)+c$).

In the end, the level adapted signal l'(k) determined either according to $m_l(k)*l(k)+c(k)$ or $A_{soll,l}(k)+(|l(k)+c(k)|-A_{soll,l}(k))*n$, as discussed above, is then put through an inverse transformation, as shown in step 106, to determine the first sum signal L'.

Figure 4:
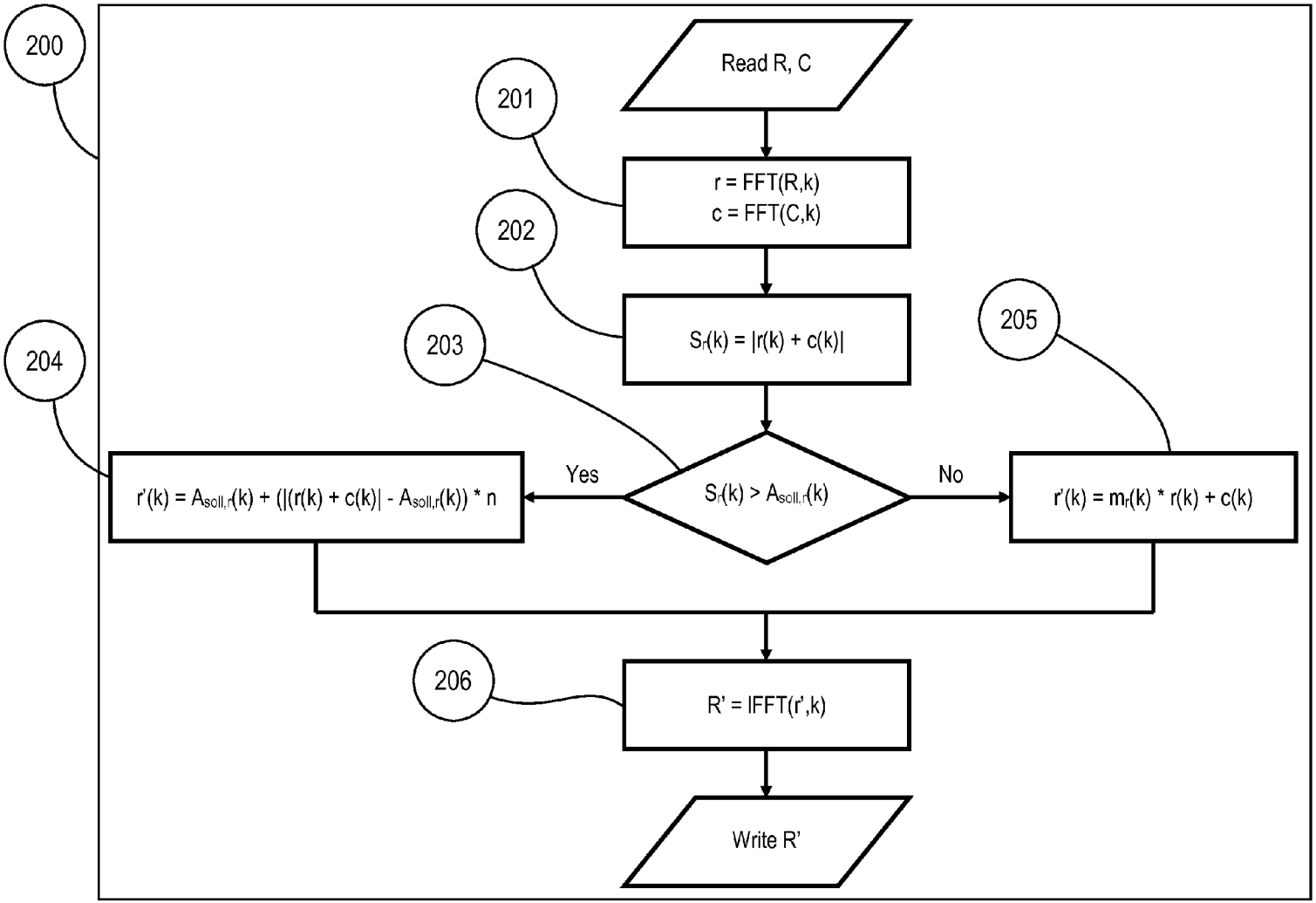

In FIG. 4, Analysis and Correction 2 (block 200) is designed to carry out a first transformation of the input right and centre signals R and C to spectral values, e.g. via a FFTs, as shown in step 201. The formed spectral values r(k) and c(k) are added in the sum function shown in step 202. The absolute value $S_r(k)$ of the sum of the spectral values is assessed in step 203 according to if the absolute value $S_r(k)$ is greater than a desired value $A_{soll,r}(k)$. The desired value $A_{soll,r}(k)$ is determined according to the following:

$$A_{soll,r}(k)=\sqrt{|r(k)|^2+|c(k)|^2}$$

If the absolute value $S_r(k)$ is greater than $A_{soll,r}(k)$ then the value r'(k) of the right channel is determined in step 204 as:

$$r'(k)=A_{soll,r}(k)+(|r(k)+c(k)|-A_{soll,r}(k))*n,$$

where n is a factor greater than 0.1 and less than 0.4.

If the absolute value $S_r(k)$ is not greater than the desired value $A_{soll,r}(k)$, then the spectral value r'(k) of the right channel is determined according to step 205, in which the spectral value r(k) is multiplied by a factor $m_r(k)$. The factor $m_r(k)$ is greater than 1 and is used to adapt the level, similar to the aforementioned factor n. The product $m_r(k)*r(k)$ is added to the spectral value c(k) of the centre channel (i.e., $m_r(k)*r(k)+c(k)$).

In the end, the level adapted signal r'(k) determined either according to $m_r(k)*r(k)+c(k)$ or $A_{soll,r}(k)+(|r(k)+c(k)|-A_{soll,r}(k))*n$, as discussed above, is then put through an inverse transformation, as shown in step 106, to determine the second sum signal R'.

Figure 5:
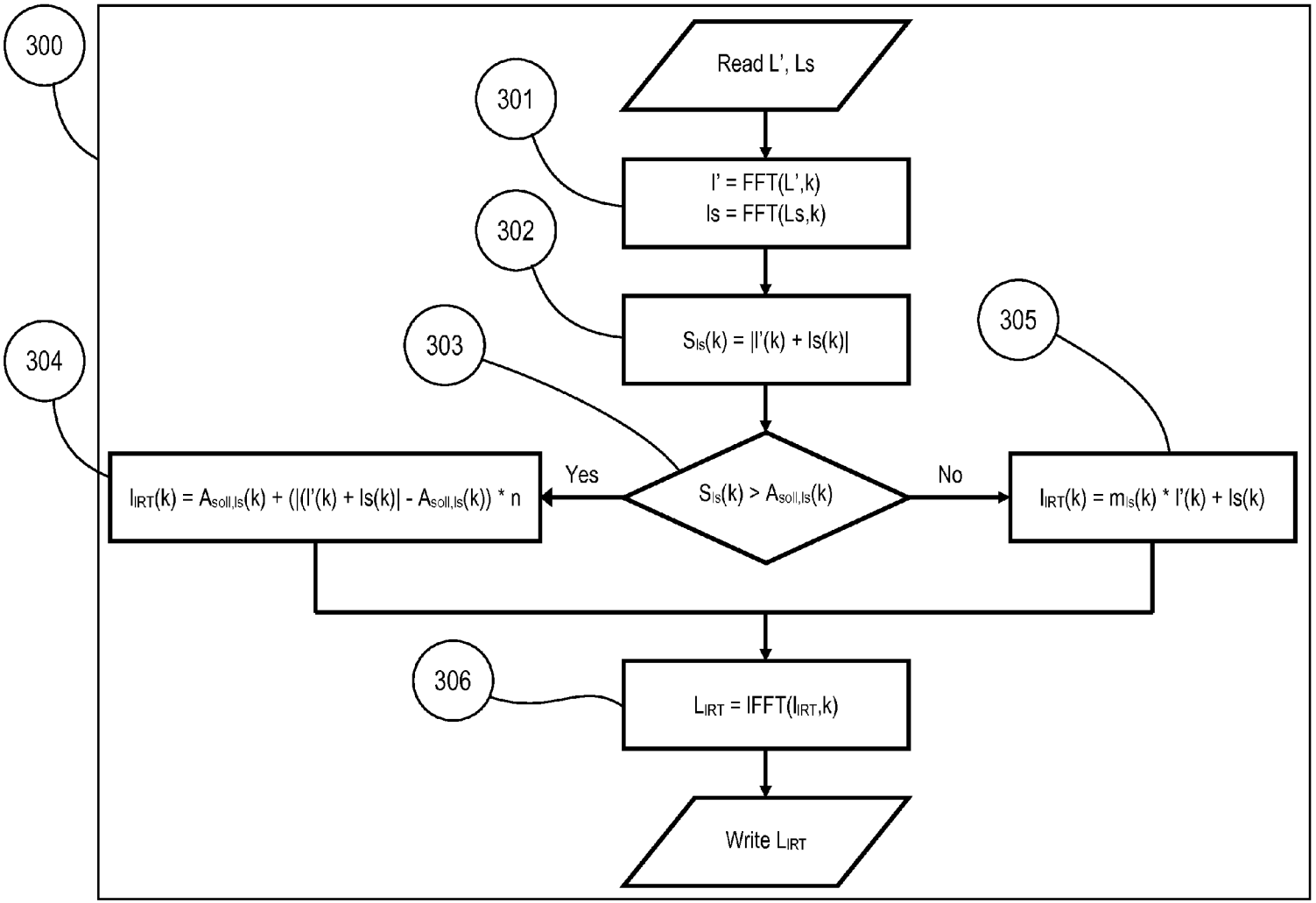

In FIG. 5, Analysis and Correction 3 (block 300) is designed to carry out a first transformation of the input rear left signal Ls and the first sum signal L' to spectral values, e.g. via FFTs, as shown in step 301. The formed spectral values ls(k) and l'(k) are added in the sum function shown in step 302. The absolute value $S_{ls}(k)$ of sum of the spectral values is assessed in step 303 according to if the absolute value $S_{ls}(k)$ is greater than a desired value $A_{soll,ls}(k)$. The desired value $A_{soll,ls}(k)$ is determined according to the following:

$$A_{soll,ls}(k)=\sqrt{|ls(k)|^2+|l'(k)|^2}$$

If the absolute value $S_{ls}(k)$ is greater than $A_{soll,ls}(k)$, then the value $l_{lRT}$ of the rear left channel is determined in step 304 as:

$$l_{lRT}(k)=A_{soll,ls}(k)+(|ls(k)+l'(k)|-A_{soll,ls}(k))*n,$$

where n is a factor greater than 0.1 and less than 0.4.

If the absolute value $S_{ls}(k)$ is not greater than the desired value $A_{soll,ls}(k)$, then the spectral value $l_{lRT}$ is determined according to step 305, in which the spectral value l'(k) is multiplied by a factor $m_{ls}(k)$. The factor $m_{ls}(k)$ is greater than one and is used to adapt the level, similar to the aforementioned factor n. The product $m_{ls}(k)*l'(k)$ is added to the spectral value ls(k) of the rear left channel (i.e., $m_{ls}(k)*l'(k)+ls(k)$).

In the end, the level adapted signal determined either according to $m_{ls}(k)*l'(k)+ls(k)$ or $A_{soll,ls}(k)+(|l'(k)+ls(k)|-A_{soll,ls}(k))*n$, as discussed above, is then put through an inverse transformation, as shown in step 306, to determine the third sum signal and therefore the left output signal L.

Figure 6:
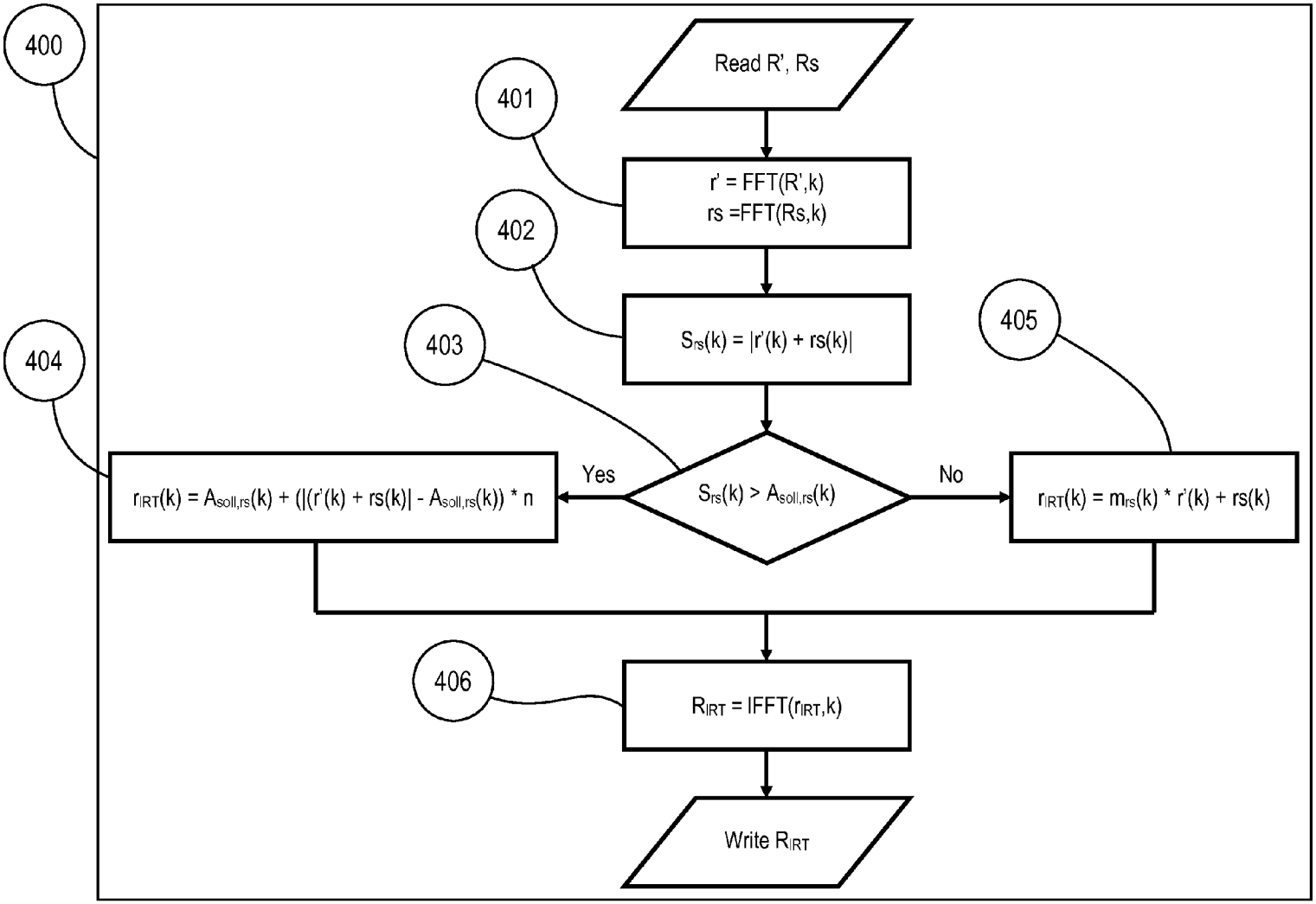

In FIG. 6, Analysis and Correction 4 (block 400) is designed to carry out a first transformation of the input rear right signal Rs and the second sum signal R' to spectral values, e.g. via FFTs, as shown in step 401. The formed spectral values rs(k) and r'(k) are added in the sum function shown in step 402. The absolute value $S_{rs}(k)$ of the sum of the spectral values is assessed in step 403 according to if the absolute value $S_{rs}(k)$ is greater than a desired value $A_{soll,rs}(k)$. The desired value ($A_{soll,rs}(k)$) is determined according to the following:

$$A_{soll,rs}(k)=\sqrt{|rs(k)|^2+|r'(k)|^2}$$

If the absolute value $S_{rs}(k)$ is greater than $A_{soll,ls}(k)$, then the value $r_{lRT}$ of the rear right channel is determined in step 404 as:

$$r_{lRT}(k)=A_{soll,rs}(k)+(|r'(k)+rs(k)|-A_{soll,rs}(k))*n,$$

where n is a factor greater than 0.1 and less than 0.4.

If the absolute value $S_{rs}(k)$ is not greater than the desired value $A_{soll,rs}(k)$, then the spectral value $r_{lRT}$ is determined according to step 405, in which the spectral value r'(k) is multiplied by a factor $m_{rs}(k)$. The factor $m_{rs}(k)$ is greater than one and is used to adapt the level, similar to the aforementioned factor n. The product $m_{rs}(k)*r'(k)$ is added to the spectral value rs(k) of the rear right channel (i.e., $m_{rs}(k)*r'(k)+rs(k)$).

In the end the level adapted signal determined either according to $m_{rs}(k)*r'(k)+rs(k)$ or $A_{soll,rs}(k)+(|r'(k)+rs(k)|-A_{soll,rs}(k))*n$, as discussed above, is then put through an inverse transformation, as shown in step 406, to determine the fourth sum signal and therefore the right output signal R.

The invention claimed is:

1. A method of generating a downward compatible two-channel sound format having a right channel ($R_{lRT}$) and a left channel ($L_{lRT}$) from a five channel sound format having the following sound channels:

left channel (L)
right channel (R)
centre channel (C)
rear left channel (Ls)
rear right channel (Rs), whereas the level of the centre channel (C) is lowered,
the level of the centre channel (C) is distributed to the left channel (L) so as to form the left channel (L) so as to form a first sum signal (L'),
the level of the rear left channel (Ls) is lowered,
the rear left channel (Ls), the level of which has been lowered, is distributed to the first sum signal so as to form the third sum signal which corresponds to the left channel ($L_{lRT}$) of the two channel sound format,
the centre channel (C), the level of which has been lowered, is distributed to the right channel (R) so as to form a second sum signal (R'),
the level of the rear right channel (Rs) is lowered,
the rear right channel (Rs) the level of which has been lowered, is distributed to the second sum signal to form a fourth sum signal which corresponds to the right channel ($R_{lRT}$) of a two channel sound format, wherein:

while forming the first sum signal (L') and the second sum signal (R') for spectral values of overlapping time windows each is dynamically corrected with k samples of the left channel (L) and the right channel (R), and
while forming the third and fourth sum signal for spectral values of overlapping time windows each is dynamically corrected with k samples of the first sum signal (L') and the second sum signal (R'),
that before each dynamic correction of the spectral values of the left channel (L) and the right channel (R), every sum of the spectral values is compared with a desired value ($A_{soll}$, with $A_{soll}$ R), which follows from the following relationship:

$$A_{soll,l}(k)=\sqrt{|l(k)|^2+|c(k)|^2}$$

$$A_{soll,r}(k)=\sqrt{|r(k)|^2+|c(k)|^2}$$

where

|l(k)| is the absolute value of a spectral value of the transformed left channel (L) in the complex plane C,
|c(k)| is the absolute value of the respective spectral value of the transformed centre channel (C) in the complex plane C,
|r(k)| is the absolute value of a spectral value of the transformed right channel (R) in the complex plane C, that before each dynamic correction of the spectral values of the first sum signal (L') and the second sum signal (R'), every sum of the spectral values is compared with a desired value ($A_{soll}$, with $A_{soll}$ R), which follows from the following relationship:

$$A_{soll,ls}(k)=\sqrt{|l'(k)|^2+|ls(k)|^2}$$

$$A_{soll,rs}(k)=\sqrt{|r'(k)|^2+|rs(k)|^2}$$

where

|r'(k)| is the absolute value of the spectral values of the transformed third sum signal (R') in the complex plane C,
|l'(k)| is the absolute value of the respective spectral values of the transformed first sum signal (L') in the complex plane C,
|rs(k)| is the absolute value of the spectral values of the transformed rear right channel (Rs) in the complex plane C,
|ls(k)| is the absolute value of the respective spectral values transformed rear left channel (Ls) in the complex plane C, that in case the desired value ($A_{soll}$) is exceeded, the frequency component is added and the resulting sum is lowered according to $$S(k)=A_{soll}(k)+(|A(k)+B(k)|-A_{soll}(k))*n$$

and for the case that the desired value ($A_{soll}$) is undercut, the spectral values of the respective signal is multiplied with the following multiplier (m(k), with m(k) R):

$$m(k)=\frac{-p+\sqrt{w\cdot p^2+(|A(k)|)^4}}{|A(k)|^2}$$

where

A(k) is the k-th spectral value of r', l', l and r, with A(k) C,
p =R(A(k))·R(B(k))+ℑ(A(k))·ℑ(B(k)),
B(k) is the k-th spectral value of rs, ls, and c, with B(k) C, and
w is a scaling factor ranging from −1<w<1, where w R.

2. A method of generating an audio output signal according to a downward compatible sound format, the method comprising:

generating a sum signal by combining a first input channel signal with a second input channel signal; and
dynamically correcting the sum signal using samples of the first and second input channel signals from overlapping time windows to produce the audio output signal, the dynamically correcting comprising correcting each sample s of the sum signal based on a comparison to a desired value $A_{soll}$ for the sample.

3. The method recited in claim 2, wherein for each sample, $$s(k)=|A(k)+B(k)|, \text{ and}$$

$$A_{soll}(k)=\sqrt{|A(k)|^2+|B(k)|^2},$$

where:

k is the sample number, and
A(k) and B(k) are spectral values, respectively, of the transformed first and second channel signals in the complex plane C for the sample k.

4. The method recited in claim 3, wherein if the sum signal s for a given sample k is greater than the desired value $A_{soll}$ for the sample k, the spectral value S(k) of the audio output signal is determined by:

$$S(k)=A_{soll}(k)+(|A(k)+B(k)|-A_{soll}(k))*n,$$

otherwise, S(k) is determined by:

$$S(k)=m(k)*A(k)+B(k),$$

where n and m are multiplying factors.

5. The method recited in claim 4, wherein n is a predetermined multiplying factor between 0.1 and 0.4, and $$m(k) = \frac{-p + \sqrt{w \cdot p^2 + (|A(k)|)^4}}{|A(k)|^2},$$

where p =R(A(k))·R(B(k))+ℑ(A(k))·ℑ(B(k)), and w is a scaling factor between −1 and 1.

6. A method of generating an audio output signal according to a downward compatible sound format, the method comprising:

combining a left input channel signal L with a center input channel signal C;

dynamically correcting the L/C signal combination using samples of the left input channel signal L and the center input channel signal C from overlapping time windows to produce a left sum signal L';

combining a right input channel signal R with the center input channel signal C, the center input channel signal C being lowered before being combined with the left input channel signal L or the right input channel signal R; and dynamically correcting the R/C signal combination using samples of the right input channel signal R and the center input channel signal C from overlapping time windows to produce a right sum signal R'.

7. The method recited in claim 6, wherein dynamically correcting the L/C signal combination or dynamically correcting the R/C signal combination comprises correcting each sample S of the corresponding signal combination based on a comparison to a desired value $A_{soll}$ for the sample.

8. The method recited in claim 7, wherein for dynamically correcting the L/C signal combination, $$S_l(k)=|l(k)+c(k)|, \text{ and}$$

$$A_{soll,l}(k)=\sqrt{|l(k)|^2+|c(k)|^2},$$

where:

k is the sample number, and l(k) and c(k) are spectral values, respectively, of the transformed left and center input channels L and C in the complex plane C for the sample k.

9. The method recited in claim 8, wherein if the L/C signal combination $S_l$ for a given sample k is greater than the desired value $A_{soll,l}$ for the sample k, the spectral value l'(k) of the transformed left sum signal L' is determined by:

$$l(k)=A_{soll}(k)+(|l(k)+c(k)|-A_{soll,l}(k))*n,$$

otherwise, l'(k) is determined by:

$$l(k)=m_l(k)*l(k)+c(k),$$

where n and $m_l$ are multiplying factors.

10. The method recited in claim 9, wherein n is a predetermined multiplying factor between 0.1 and 0.4, and $$m_l(k) = \frac{-p + \sqrt{w \cdot p^2 + (|l(k)|)^4}}{|l(k)|^2},$$

where p =R(l(k))·R(c(k))+ℑ(l(k))·ℑ(c(k)), and w is a scaling factor between −1 and 1.

11. The method recited in claim 7, wherein for dynamically correcting the R/C signal, $$S_r(k)=|r(k)+c(k)|, \text{ and}$$

$$A_{soll,r}(k)=\sqrt{|r(k)|^2+|c(k)|^2},$$

where:

k is the sample number, and r(k) and c(k) are spectral values, respectively, of the transformed right and center input channels R and C in the complex plane C for the sample k.

12. The method recited in claim 11, wherein if the R/C signal combination $S_r$ for a given sample k is greater than the desired value $A_{soll,r}$ for the sample k, the spectral value r'(k) of the transformed right sum signal R' is determined by:

$$r'(k)=A_{soll,r}(k)+(|r(k)+c(k)|-A_{soll,r}(k))*n,$$

otherwise, r'(k) is determined by:

$$r(k)=m_r(k)*r(k)+c(k),$$

where n and $m_r$ are multiplying factors.

13. The method recited in claim 12, wherein n is a predetermined multiplying factor between 0.1 and 0.4, and $$m_r(k) = \frac{-p + \sqrt{w \cdot p^2 + (|r(k)|)^4}}{|r(k)|^2},$$

where p =R(r(k))·R(c(k))+ℑ(r(k))·ℑ(c(k)), and w is a scaling factor between −1 and 1.

14. The method recited in claim 6, further comprising:

combining the left sum signal L' with a rear left input channel signal Ls;

dynamically correcting the L'/Ls signal combination using samples of the left sum signal L' and the rear left input channel signal Ls from overlapping time windows to produce a left output signal $L_{lRT}$;

combining the right sum signal R' with a rear right input channel signal Rs; and dynamically correcting the R'/Rs signal combination using samples of the right sum signal R' and the rear right input channel signal Rs from overlapping time windows to produce a right output signal $R_{lRT}$.

15. The method recited in claim 14, wherein the rear left input channel signal Ls and the rear right input channel signal Rs are lowered before being respectively combined with the left sum signal L' and the right sum signal R'.

16. The method recited in claim 14, wherein dynamically correcting the L'/Ls signal combination or the R'/Rs signal combination comprises correcting each sample S of the corresponding signal combination based on a comparison to a desired value $A_{soll}$ for the sample.

17. The method recited in claim 16, wherein for dynamically correcting the L'/Ls signal combination, $$S_{ls}(k)=|l'(k)+ls(k)|, \text{ and}$$

$$A_{soll,ls}(k)=\sqrt{|l'(k)|^2+|ls(k)|^2},$$

where:

k is the sample number, and l'(k) and ls(k) are spectral values, respectively, of the transformed left sum signal L' and rear left input channel Ls in the complex plane C for the sample k.

18. The method recited in claim 17, wherein if the L'/Ls signal combination $S_{ls}$ for a given sample k is greater than the desired value $A_{soll,ls}$ for the sample k, the spectral value $l_{lRT}(k)$ of the left output signal $L_{lRT}$ is determined by:

$$l_{lRT}(k)=A_{soll,ls}(k)+(|l'(k)+ls(k)|-A_{soll,ls}(k))*n,$$

otherwise, $l_{lRT}(k)$ is determined by:

$$l_{lRT}(k)=m_{ls}(k)*l'(k)+ls(k),$$

where n and $m_{ls}$ are multiplying factors.

19. The method recited in claim 18, wherein n is a predetermined multiplying factor between 0.1 and 0.4, and $$m_{ls}(k)=\frac{-p+\sqrt{w\cdot p^2+(|l'(k)|)^4}}{|l'(k)|^2},$$

where p =R(l'(k))·R(ls(k))+ℑ(l'(k))·ℑ(ls(k)), and w is a scaling factor between −1 and 1.

20. The method recited in claim 16, wherein for dynamically correcting the R'/Rs signal combination, $$S_{rs}(k)=|r'(k)+rs(k)|, \text{ and}$$

$$A_{soll,rs}(k)=\sqrt{|r'(k)|^2+|rs(k)|^2},$$

where:

k is the sample number, r'(k) and rs(k) are spectral values, respectively, of the transformed right sum signal R' and rear right input channel Rs in the complex plane C for the sample k.

21. The method recited in claim 20, wherein if the R'/Rs signal combination $S_{rs}$ for a given sample k is greater than the desired value $A_{soll,rs}$ for the sample k, the spectral value $r_{lRT}(k)$ of the right output signal $R_{lRT}$ is determined by:

$$r_{lRT}(k)=A_{soll,rs}(k)+(|r'(k)+rs(k)|-A_{soll,rs}(k))*n,$$

otherwise, $r_{lRT}(k)$ is determined by:

$$r_{lRT}(k)=m_{rs}s(k)*r'(k)+rs(k),$$

where n and $m_{rs}$ are multiplying factors.

22. The method recited in claim 21, wherein n is a predetermined multiplying factor between 0.1 and 0.4, and $$m_{rs}(k)=\frac{-p+\sqrt{w\cdot p^2+(|r'(k)|)^4}}{|r'(k)|^2},$$

where p =R(r'(k))·R(rs(k))+ℑ(r'(k))·ℑ(rs(k)), and w is a scaling factor between −1 and 1.

23. An audio playback apparatus comprising:

a first input channel that receives a first input signal;

a second input channel that receives a second input signal;

an output channel that outputs an output signal, the output signal being at least partially determined by combining the first input signal and the second input signal to generate a sum signal and dynamically correcting the sum signal using samples of the first and second input channels from overlapping time windows, the dynamically correcting comprising correcting each sample s of the sum signal based on a comparison to a desired value $A_{soll}$ for the sample.

24. An audio playback apparatus comprising:

a left input channel that receives a left input signal L;

a right input channel that receives a right input signal R;

a center input channel that receives a center input signal C;

a left output channel that outputs a left output signal $L_{lRT}$, the left output signal $L_{lRT}$ being at least partially determined by combining the left input signal L and the center input signal C and dynamically correcting the L/C signal combination using samples of the left input signal L and the center input signal C from overlapping time windows; and a right output channel that outputs a right output signal $R_{lRT}$, the right output signal $R_{lRT}$ being at least partially determined by combining the right input signal R and the center input signal C and dynamically correcting the R/C signal combination using samples of the right input signal R and the center input signal C from overlapping time windows, the center input channel signal C being lowered before being combined with the left input channel signal L or the right input channel signal R.

25. The audio playback apparatus recited in claim 24, further comprising:

a rear left input channel that receives a rear left input signal Ls;

a rear right input channel that receives a rear right input signal Rs;

wherein:

the left output signal $L_{lRT}$ is further determined by combining the dynamically corrected L/C signal combination L' and the rear left input signal Ls and dynamically correcting the L'/Ls signal combination using samples of the dynamically corrected L/C signal combination L' and the rear left input signal Ls from overlapping time windows; and the right output signal $R_{lRT}$ is further determined by combining the dynamically corrected R/C signal combination R' and the rear right input signal Rs and dynamically correcting the R'/Rs signal combination using samples of the dynamically corrected R/C signal combination R' and the rear right input signal Rs from overlapping time windows.

* * * * *